US007602123B2

(12) United States Patent
Kwon

(10) Patent No.: US 7,602,123 B2
(45) Date of Patent: Oct. 13, 2009

(54) PLASMA DISPLAY PANEL

(75) Inventor: Jae-Ik Kwon, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 817 days.

(21) Appl. No.: 11/101,404

(22) Filed: Apr. 8, 2005

(65) Prior Publication Data

US 2005/0231115 A1 Oct. 20, 2005

(30) Foreign Application Priority Data

Apr. 16, 2004 (KR) ..... 10-2004-0026203

(51) Int. Cl.
*H01J 17/49* (2006.01)

(52) U.S. Cl. ..... 313/583; 313/585

(58) Field of Classification Search ..... 313/583–585
See application file for complete search history.

(56) References Cited

U.S. PATENT DOCUMENTS 3,931,537 A * 1/1976 Nishida et al. ..... 313/583
5,541,618 A 7/1996 Shinoda
5,661,500 A 8/1997 Shinoda et al.
5,663,741 A 9/1997 Kanazawa
5,674,553 A 10/1997 Sinoda et al.

(Continued)

FOREIGN PATENT DOCUMENTS

JP 02-148645 6/1990
JP 9-251841 9/1997
JP 2845183 10/1998

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Peter Macchiarolo
(74) *Attorney, Agent, or Firm*—Robert E. Bushnell, Esq.

(57) ABSTRACT

A plasma display panel (PDP), includes a temperature difference between a display area and a peripheral area not increasing greatly in an aging process, thus preventing a damage of the PDP due to a difference between thermal expansion rates of the display area and the peripheral area. The PDP includes a transparent front substrate; a back substrate disposed in parallel to the front substrate; light emitting cells defined by barrier ribs that are disposed between the front substrate and the back substrate; address electrodes extended throughout the light emitting cells that are disposed in a row; a back dielectric layer covering the address electrodes; sustain electrode pairs, each of which includes an X electrode and a Y electrode that are extended to cross the address electrodes and parallel to each other; a front dielectric layer covering the sustain electrode pairs; a phosphor layer disposed in the light emitting cell; and a discharge gas filled in the light emitting cell. Some of the sustain electrode pairs includes the X electrodes having short connection terminals and the Y electrodes having long connection terminals, and the other sustain electrode pairs include the X electrodes having long connection terminals and the Y electrodes having short connection terminals.

20 Claims, 6 Drawing Sheets

U.S. PATENT DOCUMENTS

| | | | | |
|---|---|---|---|---|
| 5,724,054 | A | 3/1998 | Shinoda | |
| 5,786,794 | A | 7/1998 | Kishi et al. | |
| 5,952,782 | A | 9/1999 | Nanto | |
| 6,169,363 | B1 * | 1/2001 | Mori et al. | 313/582 |
| 6,285,128 | B1 * | 9/2001 | Amemiya | 313/582 |
| RE37,444 | E | 11/2001 | Kanazawa | |
| 6,343,967 | B1 * | 2/2002 | Nishiki et al. | 445/24 |
| 6,630,916 | B1 | 10/2003 | Shinoda | |
| 6,707,436 | B2 | 3/2004 | Setoguchi et al. | |
| 7,241,963 | B2 * | 7/2007 | Lee | 219/121.52 |
| 7,285,917 | B2 * | 10/2007 | Shin et al. | 315/169.1 |
| 2006/0226779 | A1 * | 10/2006 | Ahn | 313/583 |
| 2008/0129657 | A1 * | 6/2008 | Song | 345/60 |

FOREIGN PATENT DOCUMENTS

| | | | | |
|---|---|---|---|---|
| JP | 2917279 | | | 4/1999 |
| JP | 11273577 | A | * | 10/1999 |
| JP | 2001-043804 | | | 2/2001 |
| JP | 2001-325888 | | | 11/2001 |
| JP | 2005316037 | A | * | 11/2005 |
| JP | 2007026937 | A | * | 2/2007 |
| WO | 2007013528 | A1 | * | 2/2007 |

OTHER PUBLICATIONS

*Office Action* from the Korean Intellectual Property Office issued in Applicant's corresponding Korean Patent Application No. 10-2004-0026203 dated Sep. 28, 2005.

* cited by examiner

PLASMA DISPLAY PANEL

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 16 Apr. 2004 and there duly assigned Serial No. 10-2004-0026203.

BACKGROUND OF THE INVENTION

1. Field of the Invention

The present invention relates to a plasma display panel.

2. Description of the Related Art

A conventional plasma display panel (PDP) includes a front panel and a back panel. The front panel and the back panel overlap each other in an area defined by a virtual first boundary. A virtual second boundary exists inside the first boundary, and the second boundary divides a display area and a peripheral area. In the display area, light emitting cells are disposed, and an address discharge between an address electrode (not shown) disposed on each light emitting cell and a Y electrode determines whether the light emitting cell emits the light. The light emitting cells, on which the address discharge occurs, emit lights according to sustain discharge between an X electrode and a Y electrode.

The manufactured PDP undergoes a predetermined aging process. The aging process is a process, in which all light emitting cells on the PDP emit lights for a predetermined time. The light emitting characteristics of the emitting cells are stabilized through the aging process, that is, an MgO film that forms a protective layer is activated, discharge characteristic of a discharge gas is stabilized, and impurities included in a phosphor layer can be removed.

The aging process of a conventional PDP is shown as follows. Connection terminals of all Y electrodes disposed on a left connecting portion of the front panel are covered by a left conductive mesh, and the left-side conductive mesh is pressed by a pressing member including an elastic member against the connection terminals of the Y electrodes. In addition, connection terminals of all X electrodes disposed on a right-side connecting portion of the front panel are covered by a right-side conductive mesh, and the right-side conductive mesh is pressed by the pressing member including the elastic member against the connection terminals of the X electrodes. Thus, the connection terminals of the Y electrodes are electrically connected to each other by the left-side conductive mesh, and the connection terminals of the X electrodes are electrically connected to each other by the right-side conductive mesh. When voltages $V_Y$ and $V_X$ are applied to the left-side conductive mesh and the right-side conductive mesh in above status, discharges occur between the X electrodes and the Y electrodes of all the light emitting cells, and the aging process is performed.

However, if the aging process is performed simultaneously for all the light emitting cells as described above, the temperature of the display area rises due to the heat generated by the plasma discharge. Since the temperature of the peripheral area, on which the light emitting cells are not disposed, does not rise and the heat on the display area is not rapidly transferred to the peripheral area, there is a temperature difference between the display area and the peripheral area. If the temperature difference becomes larger, the PDP may be damaged due to a difference between thermal expansion rates of the display area and the peripheral area.

Recently, an amount of Xe included in the discharge gas is increased in order to improve the emitting brightness of the PDP, however, when the amount of Xe becomes larger, the above described problem becomes worse. Therefore, a solution for solving the above problem is strongly required.

SUMMARY OF THE INVENTION

It is therefore, an object of present invention to provide a plasma display panel, in which a temperature difference between a display area and a peripheral area is not increased rapidly in an aging process to prevent the PDP from being damaged by a difference between thermal expansion rates of the display area and the peripheral area.

It is another object of present invention to provide a plasma display panel that is easy to manufacture and implement and have increased efficiency and yet still provide thermal stability.

According to an aspect of the present invention, there is provided a plasma display panel including a transparent front substrate, a back substrate disposed in parallel to the front substrate, light emitting cells defined by barrier ribs that are disposed between the front substrate and the back substrate, address electrodes extended throughout the light emitting cells that are disposed in a row, a back dielectric layer covering the address electrodes, sustain electrode pairs, each of which includes an X electrode and a Y electrode that are extended to cross the address electrodes and parallel to each other, a front dielectric layer covering the sustain electrode pairs, a phosphor layer disposed in the light emitting cell, a discharge gas filled in the light emitting cell. Some of the sustain electrode pairs includes the X electrodes having short connection terminals and the Y electrodes having long connection terminals, and the other sustain electrode pairs include the X electrodes having long connection terminals and the Y electrodes having short connection terminals.

According to another aspect of the present invention, there is provided the sustain electrode pair including the X electrode having short connection terminal and the Y electrode having long connection terminal and the sustain electrode pair including the X electrode having long connection terminal and the Y electrode having short connection terminal are disposed alternately.

According to another aspect of the present invention, there is provided the sustain electrode pairs including the X electrodes having short connection terminals and the Y electrodes having long connection terminals form a group 1, the sustain electrode pairs including the X electrodes having long connection terminals and the Y electrodes having short connection terminals form a group 2, and the group 1 and group 2 are disposed alternately.

According to another aspect of the present invention, there is provided the long connection terminal of the X electrode is 5 mm~20 mm (millimeters) longer than the short connection terminal of the X electrode, and the long connection terminal of the Y electrode is 5 mm~20 mm longer than the short connection terminal of the Y electrode.

According to another aspect of the present invention, there is provided the address electrodes being disposed between the back substrate and the back dielectric layer, the barrier ribs are disposed on the back dielectric layer, the sustain electrode pairs are disposed between the front substrate and the front dielectric layer, and the front dielectric layer is covered by a protective layer.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
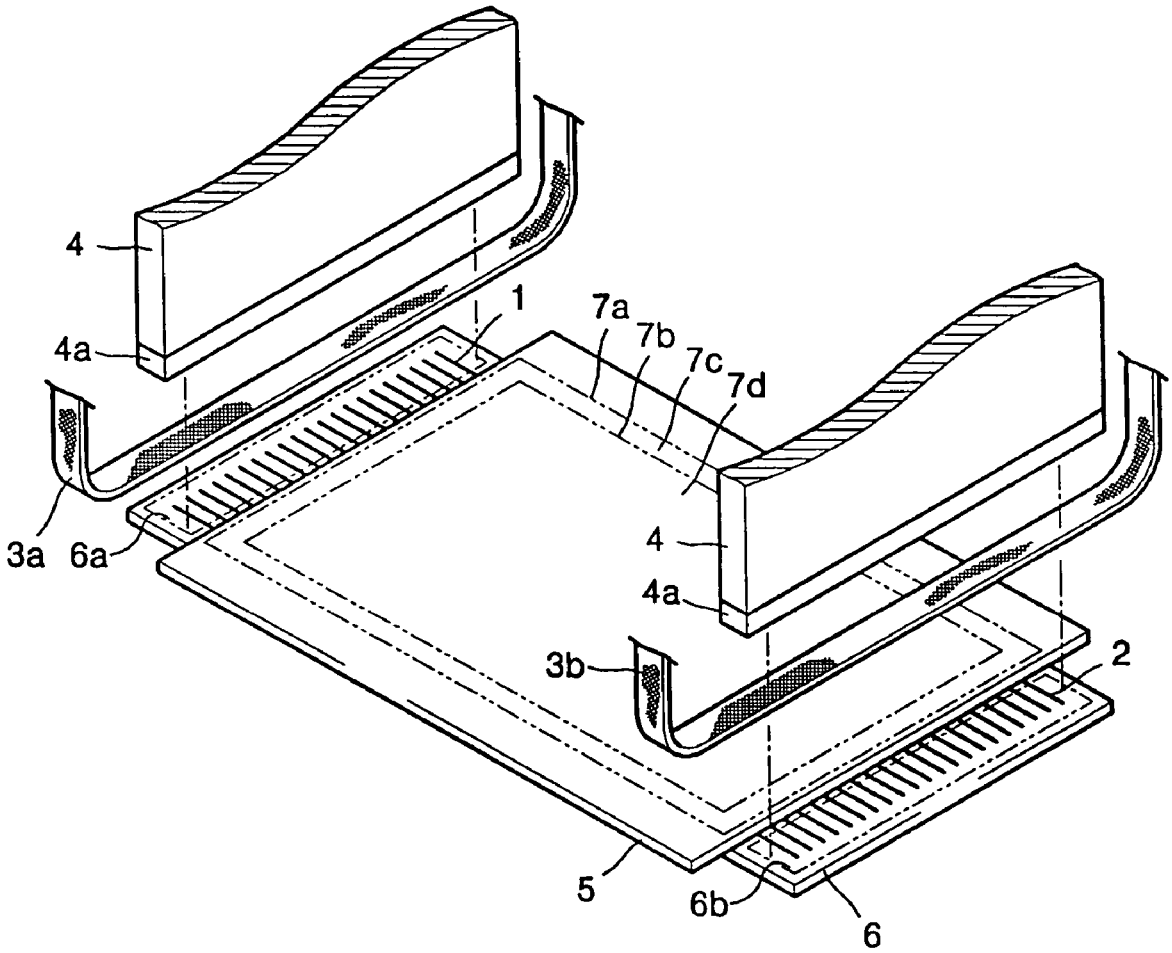
FIG. 1 (CONVENTIONAL ART)
FIG. 1 is a perspective view showing a conventional plasma display panel (PDP)

A conventional plasma display panel (PDP) shown in FIG. 1 includes a front panel 6 and a back panel 5. The front panel 6 and the back panel 5 overlap each other in an area defined by a virtual first boundary 7*a*. A virtual second boundary 7*b* exists inside the first boundary 7*a*, and the second boundary 7*b* divides a display area 7*d* and a peripheral area 7*c*. In the display area 7*d*, light emitting cells are disposed, and an address discharge between an address electrode (not shown) disposed on each light emitting cell and a Y electrode determines whether the light emitting cell emits the light. The light emitting cells, on which the address discharge occurs, emit lights according to sustain discharge between an X electrode and a Y electrode.

The manufactured PDP undergoes a predetermined aging process. The aging process is a process, in which all light emitting cells on the PDP emit lights for a predetermined time. The light emitting characteristics of the emitting cells are stabilized through the aging process, that is, an MgO film that forms a protective layer is activated, discharge characteristic of a discharge gas is stabilized, and impurities included in a phosphor layer can be removed.

Figure 2:
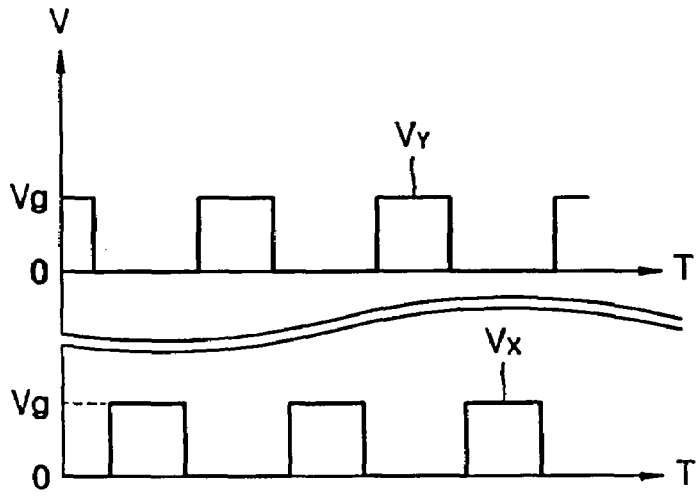
FIG. 2 is a view showing waveforms of voltages that are applied to an X electrode and a Y electrode in an aging process.

FIG. 1 shows the aging process of a conventional PDP. Connection terminals 1 of all Y electrodes disposed on a left connecting portion 6*a* of the front panel are covered by a left conductive mesh 3*a*, and the left-side conductive mesh 3*a* is pressed by a pressing member 4 including an elastic member 4*a* against the connection terminals 1 of the Y electrodes. In addition, connection terminals 2 of all X electrodes disposed on a right-side connecting portion 6*b* of the front panel 6 are covered by a right-side conductive mesh 3*b*, and the right-side conductive mesh 3*b* is pressed by the pressing member 4 including the elastic member 4*a* against the connection terminals 2 of the X electrodes. Thus, the connection terminals 1 of the Y electrodes are electrically connected to each other by the left-side conductive mesh 3*a*, and the connection terminals 2 of the X electrodes are electrically connected to each other by the right-side conductive mesh 3*b*. When voltages $V_X$ and $V_Y$ shown in FIG. 2 are applied to the left-side conductive mesh 3*a* and the right-side conductive mesh 3*b* in above status, discharges occur between the X electrodes and the Y electrodes of all the light emitting cells, and the aging process is performed. In FIG. 2, V denotes the voltage, T denotes the time, and Vg denotes the voltage applied in the aging process.

However, if the aging process is performed simultaneously for all the light emitting cells as described above, the temperature of the display area 7*d* rises due to the heat generated by the plasma discharge. Since the temperature of the peripheral area 7*c*, on which the light emitting cells are not disposed, does not rise and the heat on the display area 7*d* is not rapidly transferred to the peripheral area 7*c*, there is a temperature difference between the display area 7*d* and the peripheral area 7*c*. If the temperature difference becomes larger, the PDP may be damaged due to a difference between thermal expansion rates of the display area and the peripheral area.

Recently, an amount of Xe included in the discharge gas is increased in order to improve the emitting brightness of the PDP, however, when the amount of Xe becomes larger, the above described problem becomes worse. Therefore, a solution for solving the above problem is strongly required.

Figure 3:
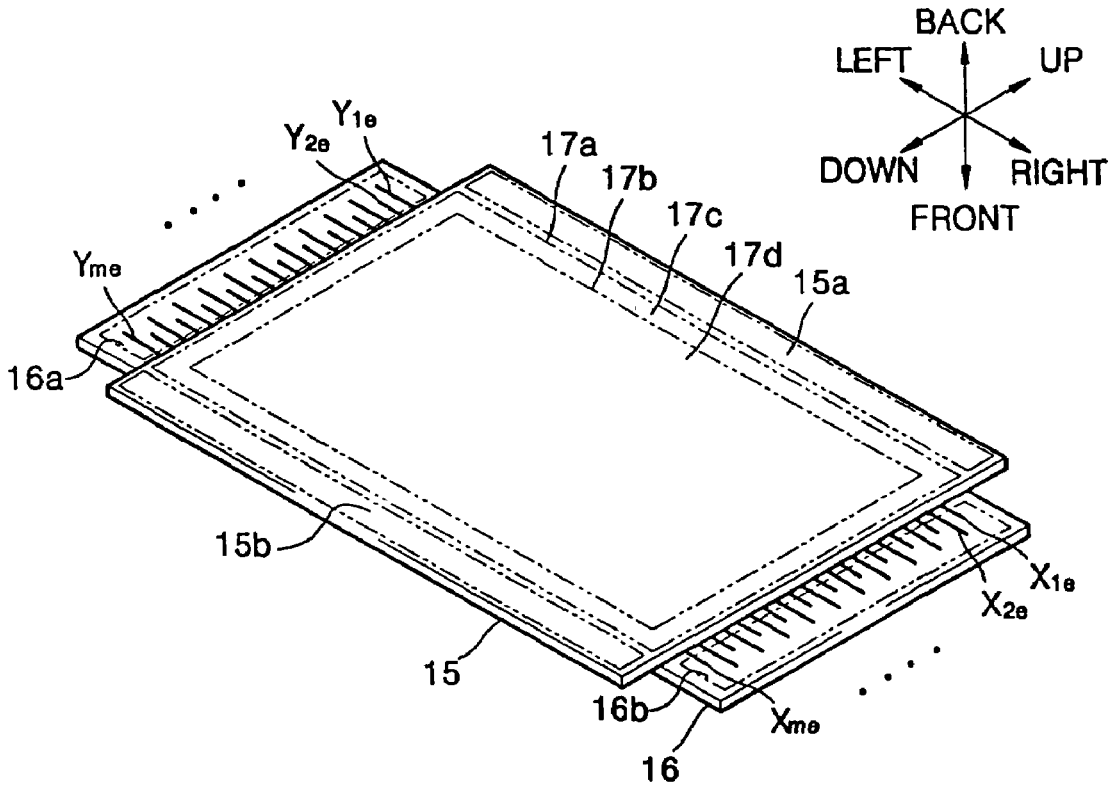
FIG. 3 is a perspective view showing a PDP according to a first embodiment of the present invention.

A plasma display panel (PDP) according to a first embodiment of the present invention will be described with reference to FIGS. 3 through 5. FIG. 3 shows a PDP according to a first embodiment of the present invention, and the PDP includes a front panel 16 and a back panel 15. The front panel 16 and the back panel 15 overlap with each other in an area defined by a virtual first boundary 17*a*. A virtual second boundary 17*b* exists inside the first boundary 17*a*, and the second boundary 17*b* divides a display area 17*d*, on which images are displayed, and a peripheral area 17*c*.

Connection terminals of address electrode, which will be described later, are disposed on an upper connecting portion 15*a* and/or a lower connecting portion 15*b* on an outer portion of the first boundary 17*a*. In addition, connection terminals $Y_{ne}$:$Y_{1e}$, . . . , $Y_{me}$ of Y electrode are disposed on a left-side connecting portion 16*a*, and connection terminals $X_{ne}$: $X_{1e}$, . . . , $X_{me}$ of X electrode are disposed on a right-side connecting portion 16*b*. The connection terminals of the address electrode, X electrode, and Y electrode are connected to a circuit unit (not shown) that drives the PDP by a connecting cable (not shown). The number of connection terminals $Y_{ne}$: $Y_{1e}$, . . . , $Y_{me}$ of the Y electrode and the connection terminals $X_{ne}$:$X_{1e}$, . . . $X_{me}$ of X electrode is not limited to those shown in FIG. 3.

Figure 4:
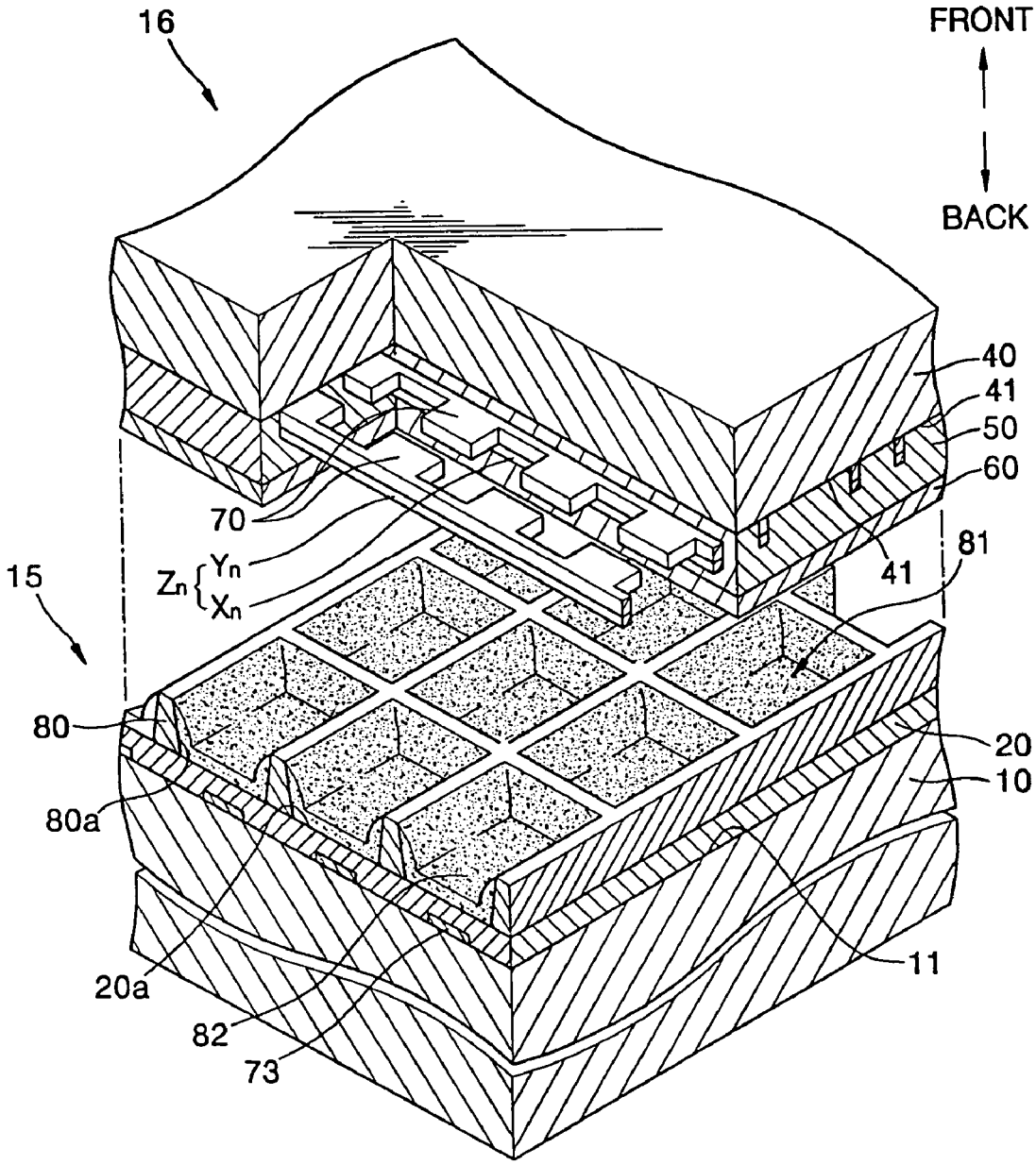
FIG. 4 is an exploded perspective view showing a display area of the PDP according to the first embodiment of the present invention.

FIG. 4 shows a part of the display area 17*d*. As shown in FIG. 4, on the display area 17*d* of the front panel 16, a transparent front substrate 40, pairs of sustain electrodes Zn, each of which includes the X electrode Xn and Y electrode Yn that are disposed on a rear portion of the front substrate 40 (more particularly, on a back surface 41 of the front substrate 40), extended along a row of light emitting cells 81, and are parallel to each other, and a front dielectric layer 50 that covers the sustain electrode pairs Zn. If necessary, a protective layer 60 covering the front dielectric layer 50 can be further disposed on the display area 17*d*.

On a display area 17*d* of the back panel 15, a back substrate 10 that is disposed to be parallel to the front substrate 40, address electrodes 73 that are disposed on a front portion of the back substrate 10 (more particularly, on a front surface 11 of the back substrate 10) and extended to cross the sustain electrode pairs Zn, a back dielectric layer 20 covering the address electrodes 73, barrier ribs 80 formed between the front substrate 40 and the back substrate 10 (more particularly, on the back dielectric layer 20) to define the light emitting cells 81, and a phosphor layer 82 disposed in the light emitting cell 81. A discharge gas is filled in each of the light emitting cells 81.

One X electrode $X_n$: one of $X_1, X_2, X_3, \ldots, X_{m-2}, X_{m-1}, X_m$ and one Y electrode $Y_n$: one of $Y_1, Y_2, Y_3, \ldots, Y_{m-2}, Y_{m-1}, Y_m$ forming one sustain electrode pair $Z_n$: one of $Z_1, Z_2, Z_3, \ldots, Z_{m-2}, Z_{m-1}, Z_m$ are extended to be parallel to each other. Relations between the connection terminals $X_{ne}$: one of $X_{1e}, X_{2e}, X_{3e}, \ldots, X_{(m-2)e}, X_{(m-1)e}, X_{me}$ of the X electrodes and the connection terminals $Y_{ne}$: one of $Y_{1e}, Y_{2e}, Y_{3e}, \ldots, Y_{(m-2)e}, Y_{(m-1)e}, Y_{me}$ will be described later.

The front substrate 40 and the back substrate 10 are generally formed of glass material, and it is desirable that the front substrate 40 has high light transmittance.

The address electrodes 73 are generally formed of a metal having higher conductivity, such as Al. The address electrode 73 is used in the address discharge with the Y electrode Yn.

The address discharge is for selecting a light emitting cell 81, which will emit the light, and the sustain discharge that will be described later occurs on the light emitting cell 81, on which the address discharge occurs.

The address electrodes 73 are covered by the back dielectric layer 20, and the back dielectric layer 20 prevents the address electrodes 73 from being damaged due to collision of charged particles to the address electrodes 73. The back dielectric layer 20 is formed of a dielectric material that induces the charged particles, such as PbO, $B_2O_3$, and $SiO_2$.

The barrier ribs 80 that define the light emitting cells 81 are formed between the front substrate 40 and the back substrate 10. The barrier ribs 80 ensure the discharge space between the front substrate 40 and the back substrate 10, prevents a cross talk from occurring between adjacent light emitting cells 81, and enlarges a surface area of the phosphor layer 82. The barrier rib 80 is formed of the glass material including an atom such as Pb, B, Si, Al, or O, and if necessary, a filler such as $ZrO_2$, $TiO_2$, and $Al_2O_3$ and a pigment such as Cr, Cu, Co, Fe, and $TiO_2$ can be further included.

In FIG. 4, the barrier ribs 80 are formed on the back dielectric layer 20, however, it is not limited thereto. For example, a reflective layer that reflects the light emitted from the phosphor layer 82 toward the front substrate 40 may be disposed between the barrier ribs 80 and the back dielectric layer 20. The barrier ribs 80 are formed in a waffle type as shown in FIG. 4, however, the shape of the barrier ribs 80 is not limited thereto.

The phosphor layer 82 is disposed in the light emitting cell 81. In FIG. 4, the phosphor layer 82 is formed on a side 80*a* of the barrier rib 80 and a front surface 20*a* of the back dielectric layer 20, however, the forming position of the phosphor layer is not limited thereto. The phosphor layer 82 includes phosphors that receive ultraviolet rays emitted from the discharge gas in the sustain discharge and emit visible rays. $Y(V,P)O_4$:Eu can be used as a red color phosphor, $Zn_2SiO_4$:Mn or $YBO_3$:Tb can be used as a green color phosphor, and BAM:Eu can be used as a blue color phosphor.

The sustain electrode pairs Zn are extended to cross the address electrodes 73 along a row of the light emitting cells 81. A sustain electrode pair includes one X electrode Xn and one Y electrode Yn, and these are formed of a metal having high electric conductivity, for example, Ag.

The X electrode Xn and the Y electrode Yn can respectively include conductive transparent electrodes that protrude toward each other. The transparent electrode makes the sustain discharge occur between the X electrode Xn and the Y electrode Yn even in a case where a distance between the X electrode Xn and the Y electrode Yn is larger. The transparent electrode 70 is formed of a conductive material that does not interfere with the light emitted from the phosphor toward the front substrate 40, for example, it can be formed of an indium tin oxide (ITO).

The sustain electrode pairs Zn are covered by the front dielectric layer 50. The front dielectric layer 40 is formed of a dielectric that can prevent the X electrode Xn and the Y electrode Yn from directly being conducted to each other and prevent the damage of the X and Y electrodes Xn and Yn by collision of the charged particles, and has high light transmittance. For example, such dielectrics as PbO, $B_2O_3$, and $SiO_2$ can be used to form the front dielectric layer 50.

It is desirable that the front dielectric layer 40 is covered by the protective layer 60. The protective layer 60 prevents the damage of front dielectric layer 50 by the collision of the charged particle onto the front dielectric layer 50, and is formed of a material emitting a plurality of secondary electrons in the sustain discharge operation, for example, MgO.

In the light emitting cell 81, the discharge gas is filled. The gas is a mixture of Ne—Xe, in which Xe of 5%~10% is included, and if necessary some of the Ne can be substituted for He.

Operation or the PDP having the above structure will be described as follows. Address voltage Va is applied between the X electrode Xn and the Y electrode Yn to perform the address discharge, and accordingly, the light emitting cells 81, on which the sustain discharge will occur, are selected. The selecting of the light emitting cell 81, on which the sustain discharge will occur, means that wall charges are accumulated so that the sustain discharge can occur on an area of the protective layer 60, which is adjacent to the X and Y electrodes Xn and Yn, in a case where the front dielectric layer 50 is covered by the protective layer. When the address discharge is completed, positive ions are accumulated on an area adjacent to the Y electrode Yn, and electrons are accumulated on an area adjacent to the X electrode Xn.

After the address discharge, when sustain voltage Vs is applied between the X and Y electrodes Yn and Xn, the positive ions accumulated on the area adjacent to the Y electrode Yn and electrons accumulated on the area adjacent to the X electrode Xn collide with each other to cause the sustain discharge. When the sustain discharge occurs, the sustain voltage Vs is alternately applied to the Y electrode Yn and the X electrode Xn.

An energy level of the discharge gas is risen by the sustain discharge, and when the risen energy level of the discharge gas becomes lower, the ultraviolet ray is emitted from the discharge gas. The ultraviolet ray rises an energy level of the phosphor included in the phosphor layer 82 disposed in the light emitting cell 81, and when the risen energy level of the phosphor becomes lower, the visible ray is emitted. The image is displayed on the display area 17*d* by the visible rays emitted from the light emitting cells 81.

Figure 5:
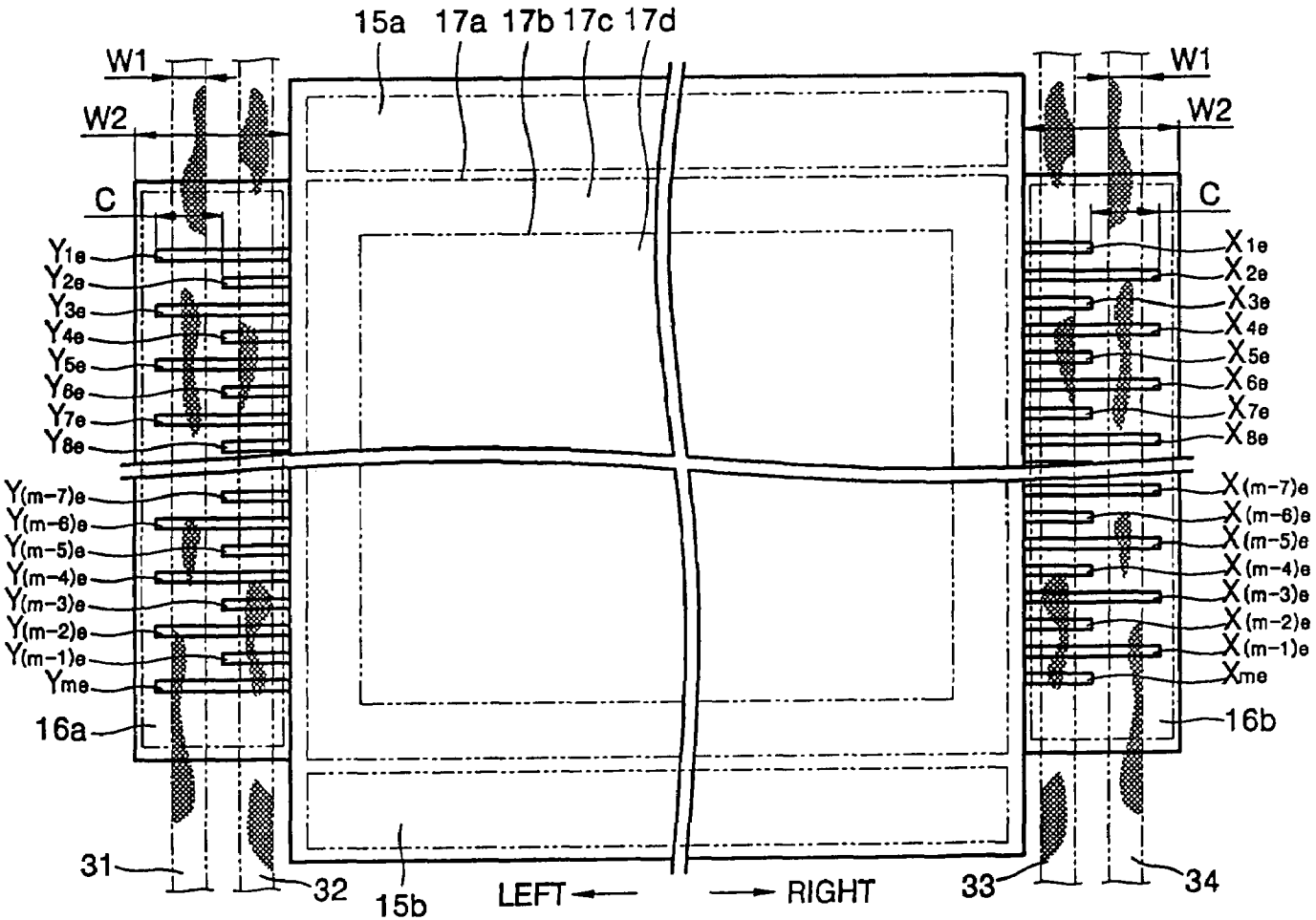
FIG. 5 is a plane view showing the PDP according to the first embodiment of the present invention.

As shown in FIG. 5, some of the sustain electrode pairs Zn includes the X electrode having short connection terminal $X_{1e}, X_{3e}, X_{5e}, \ldots, X_{(m-6)e}, X_{(m-4)e}, X_{(m-2)e}$, or $X_{me}$ and the Y electrode having long connection terminal $Y_{1e}, Y_{3e}, Y_{5e}, \ldots Y_{(m-4)e}$, or $Y_{me}$. In addition, the other sustain electrode pairs Zn include the X electrode having long connection terminal $X_{2e}, X_{4e}, X_{6e}, \ldots, X_{(m-5)e}, X_{(m-3)e}$, or $X_{(m-1)e}$ and the Y electrode having short connection terminal $Y_{2e}, Y_{4e}, Y_{6e}, Y_{(m-5)e}, Y_{(m-3)e}$, or $Y_{(m-1)e}$. In FIG. 5, the connection terminal of a certain Y electrode (for example, $Y_{1e}$) and the connection terminal of the corresponding X electrode ($X_{1e}$) are disposed on the same line, however, it can be recognized that the connection terminals $Y_{1e}$ and $X_{1e}$ are separated to be parallel to each other from FIG. 4. The Y electrode Yn shown in FIG.

4 is one electrode among the Y electrodes $Y_1, Y_2, \ldots, Y_{(m-1)}$, and $Y_m$ and the X electrode Xn forms a sustain electrode pair with the Y electrode.

The long connection terminals $X_{2e}, X_{4e}, X_{6e}, \ldots, X_{(m-5)e}, X_{(m-3)e}$, and $X_{(m-1)e}$ of the X electrodes are longer than the short connection terminals $X_{1e}, X_{3e}, X_{5e}, \ldots, X_{(m-6)e}, X_{(m-4)e}, X_{(m-2)e}$, and $X_{me}$, and the long connection terminals $Y_{1e}, Y_{3e}, Y_{5e}, \ldots Y_{(m-4)e}, Y_{(m-2)e}$, and $Y_{me}$ of the Y electrodes are longer than the short connection terminals $Y_{2e}, Y_{4e}, Y_{6e}, \ldots, Y_{(m-5)e}, Y_{(m-3)e}$, or $Y_{(m-1)e}$. That is, the connection terminal of a certain X electrode is relatively longer or shorter than that of the adjacent X electrode, and the connection terminal of a certain Y electrode is relatively longer or shorter than that of the adjacent Y electrode.

An aging method of the PDP having the above structure will be described as follows. The first left-side conductive mesh 31 shown in FIG. 5 is connected to the long connection terminals $Y_{1e}, Y_{3e}, Y_{5e}, \ldots, Y_{(m-4)e}, Y_{(m-2)e}$, and $Y_{me}$ of the Y electrodes, and the first right-side conductive mesh 33 is connected to all connection terminals $X_{1e}, X_{2e}, X_{3e}, \ldots, X_{(m-1)e}$, and $X_{me}$ of the X electrodes. In the above status, when electric waveforms $V_Y$ and $V_X$ are applied to the left-side conductive mesh 31 and the right-side conductive mesh 33, the sustain discharge only occurs between the Y electrodes having the long connection terminals $Y_{1e}, Y_{3e}, Y_{5e}, \ldots, Y_{(m-4)e}, Y_{(m-2)e}$, and $Y_{me}$ and corresponding X electrodes. Therefore, the light emitting cells 81, on which the Y electrodes having the long connection terminals $Y_{1e}, Y_{3e}, Y_{5e}, \ldots, Y_{(m-4)e}, Y_{(m-2)e}$, and $Y_{me}$ are disposed, are aged. The frequencies of the electric waveforms $V_Y$ and $V_X$ shown in FIG. 2 are about 30 kHz (kiloHertz), aging voltage Vg is 250V~350V, and duty ratio of the frequencies is 40% 70%.

On the contrary, in a state where the second left-side conductive mesh 32 is electrically connected to all connection terminals $Y_{1e}, Y_{2e}, Y_{3e}, \ldots Y_{(m-1)e}$, and $Y_{me}$ of the Y electrodes and the second right-side conductive mesh 34 is electrically connected to the long connection terminals $X_{2e}, X_{4e}, X_{6e}, \ldots, X_{(m-5)e}, X_{(m-3)e}$, and $X_{(m-1)e}$ of the X electrodes, the electric waveforms $V_Y$ and $V_X$ shown in FIG. 2 are respectively applied to the left-side conductive mesh 32 and the right-side conductive mesh 34. Then, the sustain discharge only occurs between the X electrodes having the long connection terminals $X_{2e}, X_{4e}, X_{6e}, \ldots, X_{(m-5)e}, X_{(m-3)e}$, and $X_{(m-1)e}$ and corresponding Y electrodes, thus the light emitting cells 81, on which the X electrodes having the long connection terminals $X_{2e}, X_{4e}, X_{6e}, \ldots, X_{(m-5)e}, X_{(m-3)e}$, and $X_{(m-1)e}$ are disposed, are only aged.

As described above, when the light emitting cells 81 are aged alternately, the heat amount generated on the display area 17*d* is reduced, thus the temperature difference between the display area 17*d* and the peripheral area 17*c* can be reduced. Therefore, the damage of PDP due to the great difference between the thermal expansion rates of the display area 17*d* and the peripheral area 17*c* can be prevented.

The long connection terminals $X_{2e}, X_{4e}, X_{6e}, \ldots, X_{(m-5)e}, X_{(m-3)e}$, and $X_{(m-1)e}$ of the X electrodes are 5 mm~20 mm (millimeters) longer than the short connection terminals $X_{1e}, X_{3e}, X_{5e}, \ldots X_{(m-6)e}, X_{(m-4)e}, X_{(m-2)e}$, or $X_{me}$, and the long connection terminals $Y_{1e}, Y_{3e}, Y_{5e}, \ldots, Y_{(m-4)e}, Y_{(m-2)e}$, and $Y_{me}$ of the Y electrodes are 5 mm~20 mm longer than the short connection terminals $Y_{2e}, Y_{4e}, Y_{6e}, \ldots, Y_{(m-5)e}, Y_{(m-3)e}$, or $Y_{(m-1)e}$. That is, the distance C shown in FIG. 5 is 5 mm through 20 mm.

Widths w1 of the conductive meshes 31 and 34 should be at least 2 mm for being electrically connected to the connection terminals stably, thus the distance C should be 5 mm or larger in consideration of a positional error of the conductive meshes. On the other hand, if the distance C is excessively large, widths w2 of the left connecting portion 16*a* and the right connecting portion 16*b* are increased greatly, thus a size of a case receiving the PDP should be increased. Therefore, the distance C should be 20 mm or less.

In the present embodiment, the sustain electrode pair including the X electrode having the short connection terminal and the Y electrode having the long connection terminal and the sustain electrode pair including the X electrode having the long connection terminal and the Y electrode having the short connection terminal are alternately disposed, however, the present invention is not limited thereto.

Figure 6:
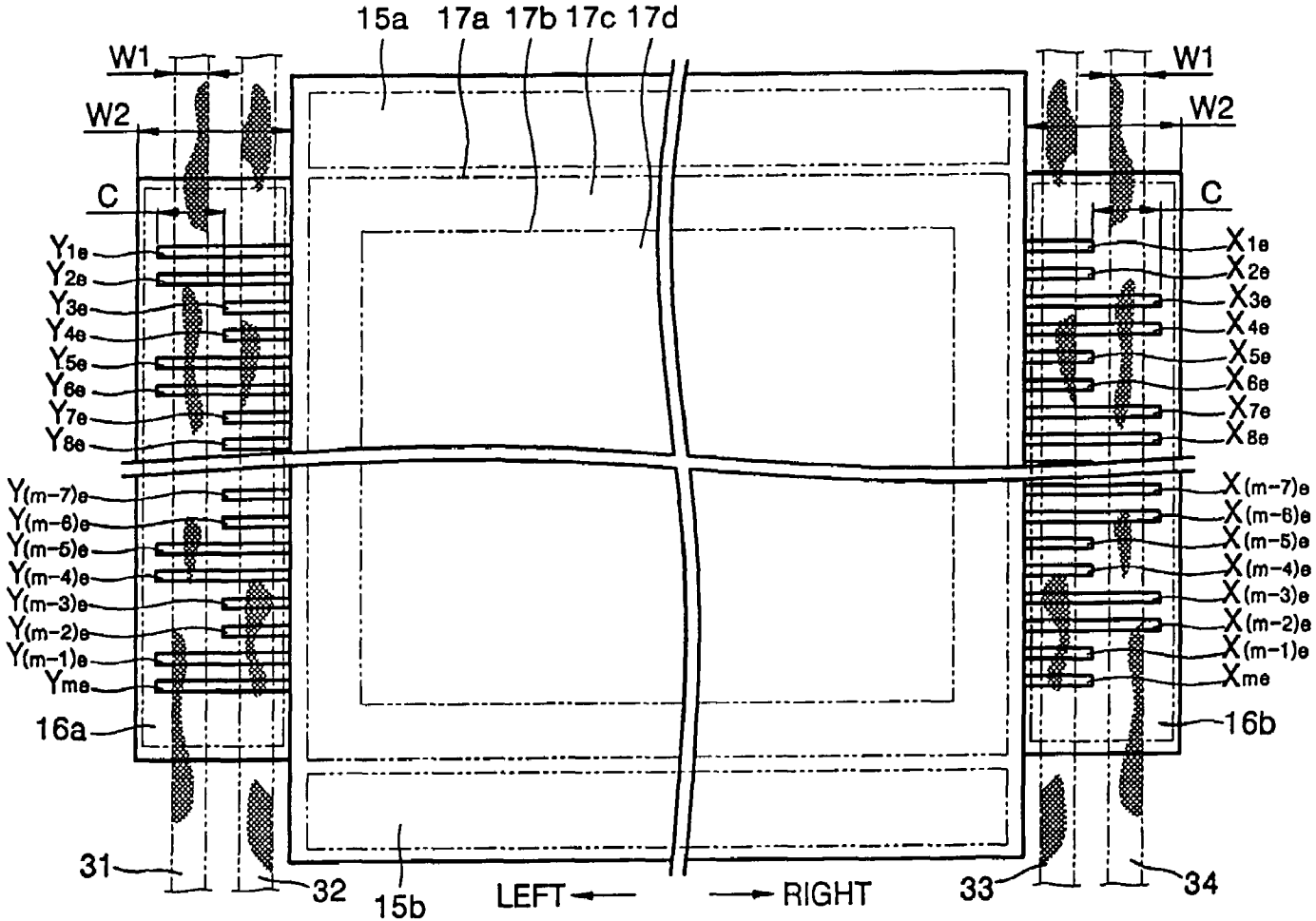
FIG. 6 is a plane view showing a PDP according to a second embodiment of the present invention.

Referring to FIG. 6, a PDP according to a second embodiment of the present invention will be described. In the present embodiment, the sustain electrode pairs that include the X electrodes having the short connection terminals and the Y electrodes having the long connection terminals form a group 1, and the sustain electrode pairs including the X electrodes having long connection terminals and the Y electrodes having short connection terminals form a group 2, and the group 1 and group 2 are disposed alternately.

Referring to FIG. 6, the sustain electrode pairs $Z_1$ and $Z_2$ including the X electrodes having the short connection terminals (for example, $X_{1e}, X_{2e}$) and the Y electrode having the long connection terminals (for example, $Y_{1e}, Y_{2e}$) form the group 1, and the sustain electrode pairs $Z_3, Z_4$ including the X electrodes having the long connection terminals (for example, $X_{3e}, X_{4e}$) and the Y electrodes having the short connection terminals (for example, $Y_{3e}, Y_{4e}$) form the group 2. The next sustain electrode pairs (for example, $Z_5, Z_6, Z_7, Z_8$) are formed to have the same structure as that of the previous sustain electrode pairs $Z_1, Z_2, Z_3, Z_4$.

In the present embodiment, although the sustain electrode pair including the X electrode having the short connection terminal and the Y electrode having the long connection terminal and the sustain electrode pair including the X electrode having the long connection terminal and the Y electrode having the short connection terminal are not disposed alternately, however, the same effects as those of the first embodiment can be obtained.

The two sustain electrode pairs form one group in the present embodiment, however it is not limited thereto, and three or more sustain electrode pairs may form one group. However, it is not desirable that ten or more sustain electrode pairs form one group since a thermal unbalance on the display area 17*d*, for example, the rising of temperature locally can be caused.

Figure 7:
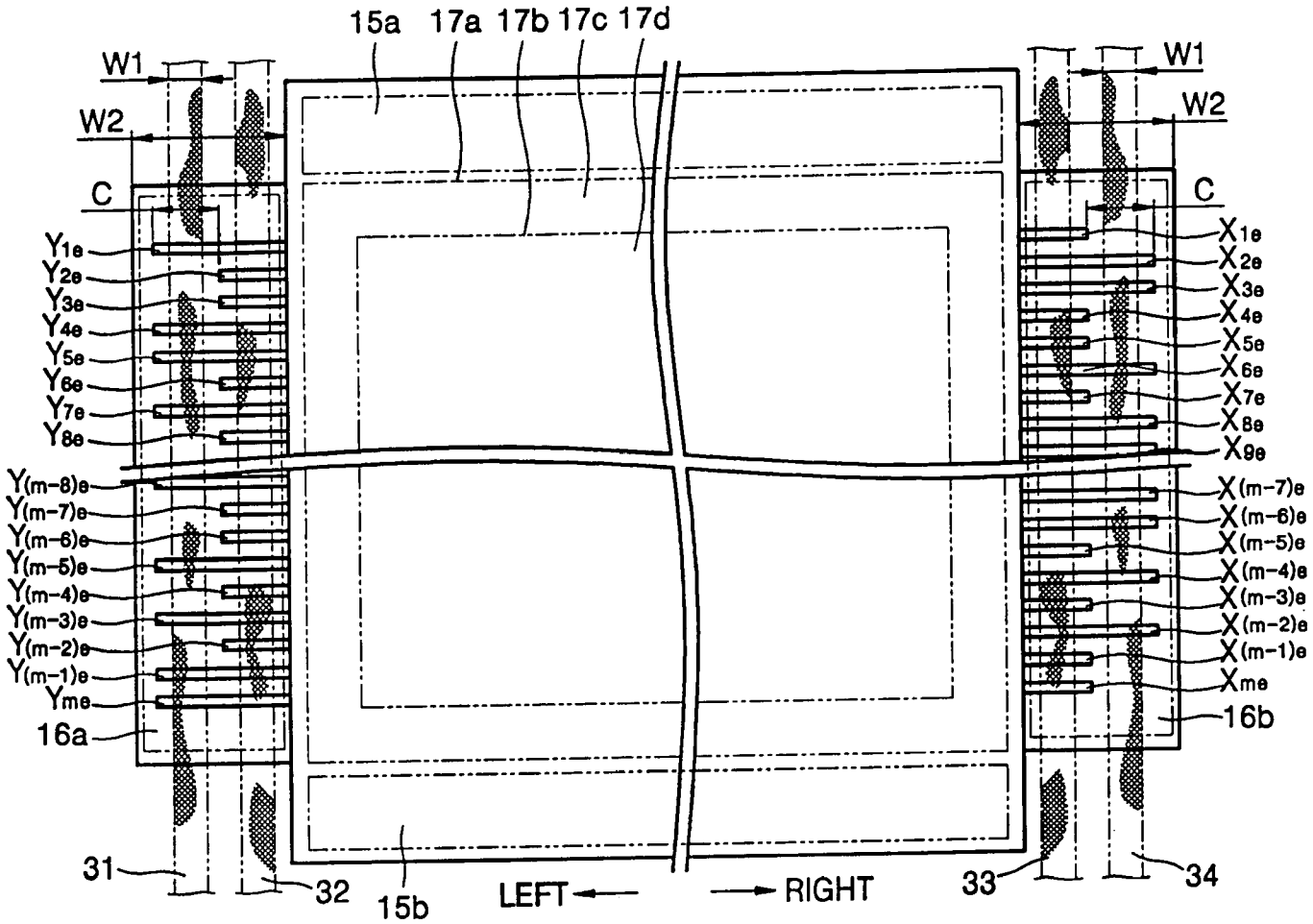
FIG. 7 is a plane view showing a PDP according to a third embodiment of the present invention.

Referring to FIG. 7, a PDP according to a third embodiment of the present invention will be described based on the differences from the first and second embodiments. In the present embodiment, the sustain electrode pairs $Z_1, Z_4, Z_5, Z_7, \ldots, Z_{(m-5)}, Z_{(m-3)}, Z_{(m-1)}$, and $Z_m$ including the X electrodes having the short connection terminals $X_{1e}, X_{4e}, X_{5e}, X_{7e}, \ldots, X_{(m-5)e}, X_{(m-3)e}, X_{(m-1)e}$, and $X_{me}$ and the Y electrodes having the long connection terminals $Y_{1e}, Y_{4e}, Y_{5e}, Y_{7e}, \ldots, Y_{(m-5)e}, Y_{(m-3)e}, Y_{(m-1)e}$, and $Y_{me}$ and the other sustain electrode pairs $Z_2, Z_3, Z_6, Z_8, \ldots Z_{(m-7)}, Z_{(m-6)}, Z_{(m-4)}$, and $Z_{(m-2)}$ are not disposed alternately with each other.

In order to obtain the same effects as those of the first embodiment, some sustain electrode pairs includes the X electrodes having the short connection terminals and the Y electrodes having the long connection terminals, and the other sustain electrode pairs include the X electrodes having the long connection terminals and the Y electrodes having the short connection terminals in the present embodiment.

However, since these sustain electrode pairs are not necessarily disposed to be alternate with each other, the sustain electrode pairs $Z_1$, $Z_4$, $Z_5$, $Z_7$, . . . $Z_{(m-5)}$, $Z_{(m-3)}$, $Z_{(m-1)}$, and $Z_m$ including the X electrodes having short connection terminals and the Y electrodes having long connection terminals and the sustain electrode pairs $Z_2$, $Z_3$, $Z_6$, $Z_8$, . . . , $Z_{(m-7)}$, $Z_{(m-6)}$, $Z_{(m-4)}$, and $Z_{(m-2)}$ including the X electrodes having long connection terminals and the Y electrodes having short connection terminals can be disposed irregularly.

According to the present invention, the temperature difference between the display area and the peripheral area in the aging process is not increased rapidly, therefore the damage of the PDP due to the difference between the thermal expansion rates of the display area and the peripheral area can be prevented.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel comprising:

a transparent front substrate;

a back substrate disposed in parallel to said front substrate;

light emitting cells being defined by barrier ribs disposed between said front substrate and said back substrate;

address electrodes extended throughout said light emitting cells, being disposed in a row;

a back dielectric layer covering said address electrodes;

sustain electrode pairs, with each one of said sustain electrode pairs comprising an X electrode and a Y electrode being extended to cross said address electrodes and parallel to each other;

a front dielectric layer covering said sustain electrode pairs;

a phosphor layer disposed in the light emitting cell; and a discharge gas filled in the light emitting cell, each X electrode comprising an X connection terminal, each Y electrode comprising a Y connection terminal, and each of the sustain electrode pairs having one of a first connection terminal configuration and a second connection terminal configuration, in the first connection terminal configuration, the X connection terminals being short while the Y connection terminals being long, and in the second connection terminal configuration, the X connection terminals being long while the Y connection terminals being short.

2. The plasma display panel of claim 1, wherein said sustain electrode pair has the first connection terminal configuration and said sustain electrode pair having the second connection terminal configuration are disposed alternately.

3. The plasma display panel of claim 1, wherein the sustain electrode pairs comprises a first group of sustain electrode pairs disposed immediately adjacent to each other and having the first connection terminal configuration, and a second group of sustain electrode pairs disposed immediately adjacent to each other and having the second connection terminal configuration, and said first group and second group are disposed alternately.

4. The plasma display panel of claim 1, wherein the long connection terminal of the X electrode is 5 millimeters to 20 millimeters longer than said short connection terminal of said X electrode, and said long connection terminal of said Y electrode is 5 millimeters to 20 millimeters longer than said short connection terminal of said Y electrode.

5. The plasma display panel of claim 1, wherein said address electrodes are disposed between said back substrate and said back dielectric layer, said barrier ribs are disposed on said back dielectric layer, said sustain electrode pairs are disposed between said front substrate and said front dielectric layer, and said front dielectric layer is covered by a protective layer.

6. The plasma display panel of claim 1, wherein said sustain electrode pair having the first connection terminal configuration and said sustain electrode pair having the second connection terminal configuration are grouped in a certain pattern.

7. The plasma display panel of claim 1, wherein said X electrodes and the Y electrodes respectively comprise conductive transparent electrodes that protrude toward each other and said transparent electrodes made of a certain conductive transparent material that does not interfere with the light emitted from the phosphor toward said front substrate.

8. The plasma display panel of claim 1, wherein connection terminal of a certain X electrode is relatively longer or shorter than that of the adjacent X electrode, and the connection terminal of a certain Y electrode is relatively longer or shorter than that of he adjacent Y electrode.

9. The plasma display panel of claim 1, wherein said long and short connection terminals being arranged to form a certain pattern of lengths for certain sustain electrode pairs.

10. The plasma display panel of claim 1, wherein, said long and short connection terminals being disposed irregularly and not alternating each of said long connection after said short connection terminal adjacent to each other.

11. A plasma display panel comprising:

a front substrate;

a back substrate arranged opposite to said front substrate;

light emitting cells being defined by barrier ribs arranged between said front substrate and said back substrate;

a plurality of address electrodes extended throughout said light emitting cells, being arranged along a line;

a back dielectric layer covering said address electrodes; and a plurality of sustain electrode pairs, with each one of said sustain electrode pairs comprising an X electrode and a Y electrode being extended to cross said address electrodes and parallel to each other, each X electrode comprising an X connection terminal, each Y electrode c comprising a Y connection terminal, and each of the sustain electrode pairs having one of a first connection terminal configuration and a second connection terminal configuration, in the first connection terminal configuration, the X connection terminals being short while the Y connection terminals being long, and in the second connection terminal configuration, the X connection terminals being long while the Y connection terminals being short, the plurality of sustain electrode pairs comprising a first group of a certain number of said plurality of sustain electrode pairs having the first connection terminal configuration, and a second group of another certain number of sustain electrode pairs having the second connection terminal configuration.

12. The plasma display panel of claim 11, wherein said first group of sustain electrode pairs and said second group of sustain electrode pairs are disposed alternately.

13. The plasma display panel of claim 11, wherein the long connection terminal of the X electrode is from and including approximately 5 millimeters to and including approximately 20 millimeters longer than said short connection terminal of said X electrode, and said long connection terminal of said Y electrode is from and including approximately 5 millimeters to and including approximately 20 millimeters longer than said short connection terminal of said Y electrode.

14. The plasma display panel of claim 11, wherein said address electrodes are disposed between said back substrate and said back dielectric layer, and said barrier ribs are disposed on said back dielectric layer.

15. The plasma display panel of claim 11, further comprising a front dielectric layer covering said plurality of sustain electrode pairs.

16. A plasma display panel comprising:

a transparent front substrate;

a back substrate disposed in parallel to said front substrate;

light emitting cells being defined by barrier ribs disposed between said front substrate and said back substrate;

address electrodes extended throughout said light emitting cells, being disposed in a row;

a back dielectric layer covering said address electrodes;

sustain electrode pairs, with each one of said sustain electrode pairs comprising an X electrode and a Y electrode being extended to cross said address electrodes and parallel to each other, each X electrode comprising an X connection terminal, each Y electrode comprising a Y connection terminal, and each of the sustain electrode pairs having one of a first connection terminal configuration and a second connection terminal configuration, in the first connection terminal configuration, the X connection terminals being short while the Y connection terminals being long and in the second connection terminal configuration, the X connection terminals being long while the Y connection terminals being short, a first portion of the sustain electrode pairs having the first connection terminal configuration, and a second portion of said sustain electrode pairs having the second connection terminal configuration, with said first portion and said second portion of said sustain electrode pairs being arranged in a certain order;

a front dielectric layer covering said sustain electrode pairs;

a phosphor layer disposed in the light emitting cell; and a discharge gas filled in the light emitting cell.

17. The plasma display panel of claim 16, with said first portion and said second portion of said sustain electrode pairs arranged alternately.

18. The plasma display panel of claim 16, wherein said sustain electrode pairs having the first connection terminal configuration form a first group of more than one and less than ten sustain electrode pairs, said sustain electrode pairs having the second connection terminal configuration form a second group of more than one and less than ten sustain electrode pairs, and said first group and second group are arranged to form a certain pattern for a certain number of sustain electrode pairs.

19. The plasma display panel of claim 16, wherein the long connection terminal of the X electrode is between 5 millimeters to 20 millimeters longer than said short connection terminal of said X electrode, and said long connection terminal of said Y electrode is between 5 millimeters to 20 millimeters longer than said short connection terminal of said Y electrode.

20. The plasma display panel of claim 16, wherein said address electrodes are disposed between said back substrate and said back dielectric layer, said barrier ribs are disposed on said back dielectric layer, said sustain electrode pairs are disposed between said front substrate and said front dielectric layer, and said front dielectric layer is covered by a protective layer.

* * * * *